US007592967B2

(12) United States Patent
Mosebrook et al.

(10) Patent No.: US 7,592,967 B2
(45) Date of Patent: Sep. 22, 2009

(54) COMPACT ANTENNA FOR A LOAD CONTROL DEVICE

(75) Inventors: Donald R. Mosebrook, Coopersburg, PA (US); Gregory Altonen, Easton, PA (US); Robert Bollinger, Jr., Fogelsville, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 367 days.

(21) Appl. No.: 11/447,725

(22) Filed: Jun. 6, 2006

(65) Prior Publication Data

US 2006/0273970 A1 Dec. 7, 2006

Related U.S. Application Data

(60) Provisional application No. 60/687,894, filed on Jun. 6, 2005.

(51) Int. Cl.
*H01Q 21/00* (2006.01)

(52) U.S. Cl. ..... 343/867; 343/742

(58) Field of Classification Search ..... 343/867, 343/742

See application file for complete search history.

(56) References Cited

U.S. PATENT DOCUMENTS 3,550,137 A 12/1970 Kuecken
4,864,588 A 9/1989 Simpson et al.
4,932,037 A 6/1990 Simpson et al.
4,995,053 A 2/1991 Simpson et al.
5,031,082 A 7/1991 Bierend et al.
5,225,847 A 7/1993 Roberts et al.
5,239,205 A 8/1993 Hoffman et al.
5,340,954 A 8/1994 Hoffman et al.
5,608,417 A * 3/1997 de Vall ..... 343/895
5,726,644 A 3/1998 Jednacz et al.
5,736,965 A 4/1998 Mosebrook et al.
5,818,128 A 10/1998 Hoffman et al.
5,838,226 A 11/1998 Houggy et al.

(Continued)

FOREIGN PATENT DOCUMENTS

EP 0 646 984 A1 4/1995

(Continued)

OTHER PUBLICATIONS

Patent Abstracts of Japan, vol. 018, No. 672 (E-1646), Dec. 19, 1994 & JP 06 267660 A (Hitachi Lighting Ltd), Sep. 22, 1994.

*Primary Examiner*—Trinh V Dinh
*Assistant Examiner*—Dieu Hien T Duong
(74) *Attorney, Agent, or Firm*—Ostrolenk Faber LLP

(57) ABSTRACT

A compact antenna for use in a load control device for controlling the power delivered to an electric load and operable to transmit or receive radio frequency signals at a specified frequency is presented. The antenna comprises a first main radiating loop of conductive material having an inductance and a capacitor forming a circuit being resonant at the specified frequency, and a second feed loop of conductive material having two ends adapted to be electrically coupled to an electronic circuit. The second feed loop is substantially only magnetically coupled to the first main radiating loop. The antenna is disposed in an actuator button, which is provided in an opening of a traditional-style faceplate. The antenna extends beyond the faceplate of the load control device.

13 Claims, 11 Drawing Sheets

U.S. PATENT DOCUMENTS

| | | | | |
|---|---|---|---|---|
| 5,848,054 | A | 12/1998 | Mosebrook et al. | |
| 5,905,442 | A | 5/1999 | Mosebrook et al. | |
| 5,982,103 | A | 11/1999 | Mosebrook et al. | |
| 6,104,354 | A | 8/2000 | Hill et al. | |
| 6,144,346 | A | 11/2000 | Boy | |
| 6,380,696 | B1 * | 4/2002 | Sembhi et al. | 315/294 |
| 6,687,487 | B1 | 2/2004 | Mosebrook et al. | |
| 6,708,877 | B2 * | 3/2004 | Blankenship et al. | 235/375 |
| 6,803,728 | B2 | 10/2004 | Balasubramaniam et al. | |
| 7,000,837 | B2 * | 2/2006 | Akiho et al. | 235/451 |
| 7,106,261 | B2 | 9/2006 | Nagel et al. | |
| 2005/0280598 | A1 | 12/2005 | Webb et al. | 343/867 |
| 2006/0044152 | A1 | 3/2006 | Wang | |

FOREIGN PATENT DOCUMENTS

| | | |
|---|---|---|
| JP | 6-267660 | 9/1994 |

* cited by examiner

COMPACT ANTENNA FOR A LOAD CONTROL DEVICE

RELATED APPLICATIONS

This application claims priority from commonly-assigned U.S. Provisional Application Ser. No. 60/687,894, filed Jun. 6, 2005, entitled REMOTE CONTROL LIGHTING CONTROL SYSTEM, the entire disclosure of which is hereby incorporated by reference.

BACKGROUND OF THE INVENTION

1. Field of the Invention

The present invention relates to antennas and in particular, to radio frequency antennas for transmitting and receiving radio frequency (RF) signals. Even more particularly, the present invention relates to a compact antenna, which is provided for use in connection with a radio frequency controlled lighting control system.

2. Description of the Related Art

Systems for controlling an electrical device by remote control are known. For example, prior art systems and methods control the status of electrical devices such as electric lamps, from a remote location via communication links, including radio frequency links, power line carrier links or infrared links. Status information regarding the electrical devices (e.g., on, off and intensity level) is typically transmitted between specially adapted lighting control devices and at least one master control unit. At least one repeater device may also be provided to help ensure reliable communications between the master control unit and the control devices for the respective electrical devices. The repeater may be required when a control device is unable to receive control signals transmitted directly from the master control unit, and, typically, employs a repeater sequence for helping to ensure that each receiver receives those signals intended for it.

Referring now to the drawing figures, in which like reference numerals refer to like elements, there is shown in FIG. 1A a prior art arrangement of a system 100 for remote control of electrical devices. The example prior art system 100 illustrated in FIG. 1A includes configurable devices that are manufactured by the assignee of the present patent application and commercially known as the RadioRA® lighting control system. The RadioRA® lighting control system is described in greater detail in commonly-assigned U.S. Pat. No. 5,905,442, issued May 18, 1999, entitled METHOD AND APPARATUS FOR CONTROLLING AND DETERMINING THE STATUS OF ELECTRICAL DEVICES FROM REMOTE LOCATIONS, the entire disclosure of which is hereby incorporated by reference.

As shown in FIG. 1A, the hardware devices include a master control unit 102, two control devices 104, a repeater 106, a car visor control 108 that may be mounted on an automobile's sun visor, and two electrical devices 110, e.g., lamps. The devices 102, 104, 106 and 108 transmit radio frequency signals 112, which can include control information and instructions regarding the respective electrical devices 110.

In the prior art system 100 illustrated in FIG. 1A, the control devices 104 are coupled to electrical devices 110 by wire connections, such as, for example, building wiring for providing power to electrical devices. Each control device 104 includes a communications and control circuit 114 that comprises a radio frequency transmitter/receiver 116 and an antenna 118 for transmitting/receiving the radio frequency signals 112. The antenna 118 is described in greater detail in U.S. Pat. No. 5,736,965, issued Apr. 7, 1998, and U.S. Pat. No. 5,982,103, issued Nov. 9, 1999, both entitled COMPACT RADIO FREQUENCY TRANSMITTING AND RECEIVING ANTENNA AND CONTROL DEVICE EMPLOYING SAME. The entire disclosures of both patents are hereby incorporated by reference.

The communications and control circuit 114 further includes a controller 120 for adjusting the status of the attached electrical device 110. The transmitter/receiver 116 receives the radio frequency signals via the antenna 118 and transmits a status radio frequency signal with information regarding the status of the controller 120 (which indirectly reflects the status of the connected electrical device 110). The controller 120 adjusts the status of the electrical device in response to the control information. Each control device 104 further includes button(s) 122 and dimmer control(s) 124, which are further operable to allow manual adjustment of the connected electrical device 110.

The master control unit 102 includes at least one actuator 126, at least one status indicator 128, a transmitter/receiver 116, and an antenna 118. The actuators 126 enable a user to control the electrical devices 110 remotely. The status indicators 128 indicate the status of the electrical devices 110. The transmitter/receiver 116 and the antenna 118 are operable for transmitting a radio frequency signal 112 having the control information therein to control the status of the electrical devices 110, as well as for receiving status information from the control devices 104.

The master control unit 102 can take several forms. For example, the master control unit 102 can be formed as a tabletop master, which plugs into an electrical outlet and includes a conventional antenna for transmitting and receiving signals. In another form, the master control unit 102 mounts on a wall, and is sized such that the master control unit 102 fits within the confines of a standard electrical wall box. In either form, the master control unit 102 includes a plurality of controls, each associated with a particular control device or a plurality of control devices. In the prior art, the user must program the association of the electrical control devices to a particular actuator 126 on the master control unit. Further, prior art master control units 102 must be programmed in order to provide functions allowing all control devices 104 to turn on or off substantially simultaneously.

The repeater 106 may receive radio frequency signals 112 (including status information and instructions) from the master control unit 102 and, thereafter, transmit radio frequency signals 112 to the control devices 104. Further, the repeater 106 may receive radio frequency signals 112 from the control devices 104 and, thereafter, transmit them to the master control unit 102.

The car visor control 108 provides a convenient and remotely usable interface to transmit radio frequency signals 112 to the master control unit 102, and may be disposed in a vehicle, for example, on a vehicle's interior sun visor. The buttons 130 are provided for remotely activating the master control unit 102. For example, the car visor control 108 can be used to cause a lighting scene to turn on/off, or may be operated to turn the electrical devices 110 on/off, via the master control unit 102.

Thus, the master control unit 102 is operable to generate radio frequency signals, which are transmitted to and received by the control devices 104, such as light dimmers, and/or the repeater 106. The control devices 104 use the information received in the radio frequency signals 112 to control the connected electrical devices 110 to a desired intensity. The control devices 104 preferably transmit radio frequency signals 112 via antennas 118 to the master control unit 102 (or to the master control unit 102 via the repeater 106) in order to indicate the status of the control devices 104 (and thus, the connected electrical devices 110). Using the respective devices, a combination of lighting controls in different or the same rooms of a structure, for example, can be instructed to turn on/off, thereby creating a lighting "scene" according to a user's desire.

FIG. 1B shows a front view of a prior art lighting control device 104 of the lighting control system 100 of FIG. 1A. Lighting control devices 104 preferably fit into standard electrical wall boxes. The antenna 118, which comprises a part of each control device 104, is sized so as to fit within the standard electrical wall box and is preferably disposed directly behind an actuator button 150 that is provided in the opening of a designer-style faceplate 160 as shown in FIG. 1B. An example of such an antenna is described in greater detail in co-pending commonly-assigned U.S. patent application Ser. No. 10/873,033, filed Jun. 21, 2004, now U.S. Pat. No. 7,362,285, entitled COMPACT RADIO FREQUENCY TRANSMITTING AND RECEIVING ANTENNA AND CONTROL DEVICE EMPLOYING SAME, the entire disclosure of which is hereby incorporated by reference.

However, it is desirable to provide an RF load control device that has an actuator button that is provided in the opening of a traditional-style faceplate. It is also desirable to provide an RF load control device that will work with a metal faceplate. Therefore, there is a need for an antenna that is disposed behind the actuator button that is provided in the opening of a traditional-style faceplate.

SUMMARY OF THE INVENTION

According to the present invention, an antenna for an electrical load control device for controlling the power delivered to an electrical load is provided wherein the load control device comprises a controllably conductive device for controlling the power delivered to the electrical load, a controller coupled to a control input of the controllably conductive device for control of the controllably conductive device, a transmitter and/or receiver in communication with the controller, a substantially-planar mounting yoke adapted to receive a traditional-style faceplate mounted thereto, an actuator button for providing an input to the controller, and a backcover connected to the yoke to enclose the controllably conductive device, the controller, and the transmitter and/or receiver, the actuator button mounted relative to the yoke, such that the actuator button is adapted to extend through an opening of the traditional-style faceplate when the faceplate is attached to the yoke, the antenna coupled to the transmitter and/or receiver and operable to transmit or receive radio frequency signals at a specified frequency. The antenna comprises an antenna printed circuit board having first and second sides adapted to be disposed in a plane perpendicular to the mounting yoke; a first loop of conductive material having an inductance and a capacitance, the capacitance and the inductance forming a circuit resonant at the specified frequency, the first loop formed on the first side of the printed circuit board; and a second loop of conductive material having two ends adapted to be electrically coupled to the transmitter and/or receiver, the second loop formed on one of the sides of the printed circuit board and magnetically coupled to the first loop; wherein the antenna is positioned inside and behind the actuator button and extends through the opening of the faceplate beyond a front surface of the faceplate when the faceplate is attached to the yoke.

Other features and advantages of the present invention will become apparent from the following description of the invention, which refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1A:
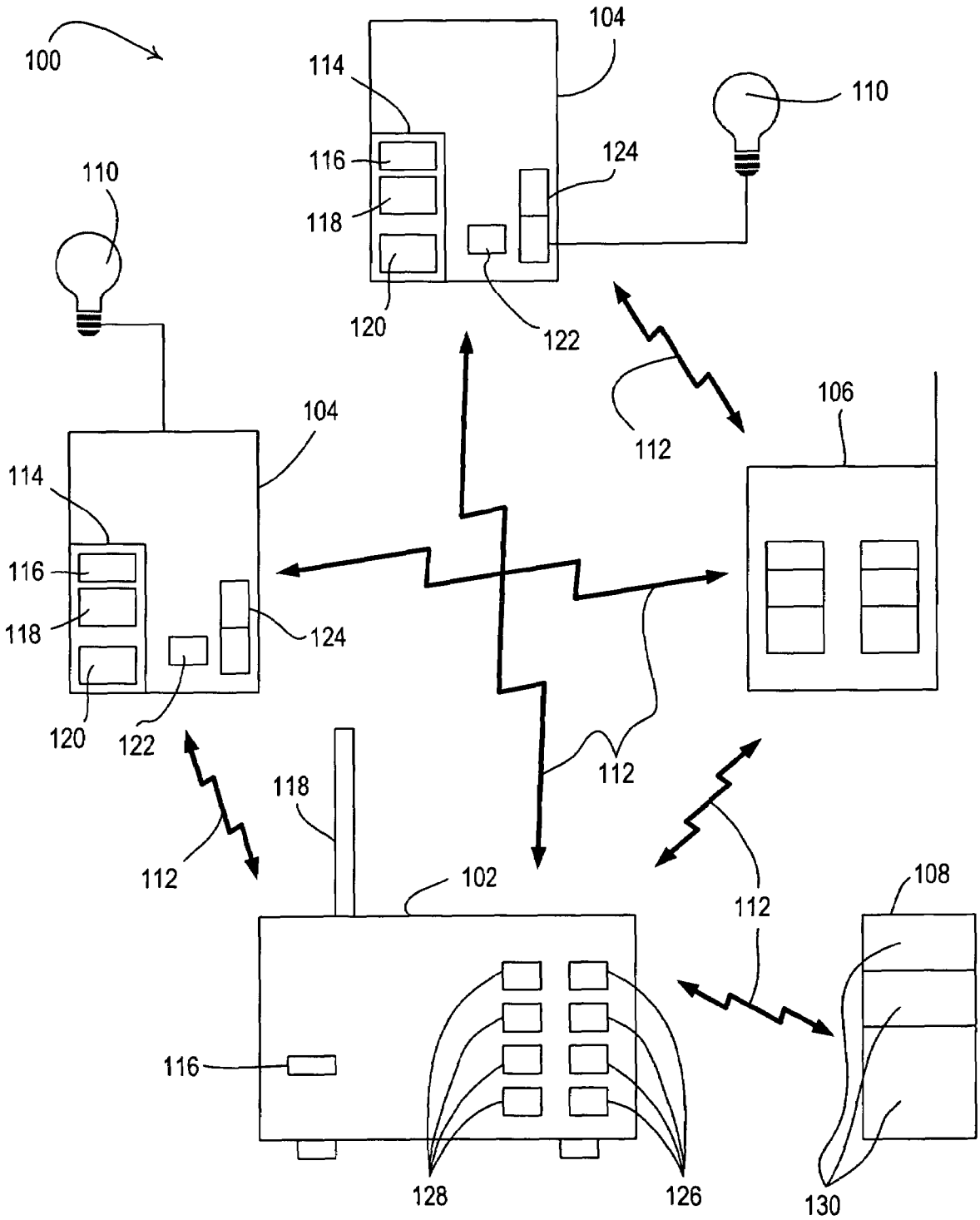
FIG. 1A PRIOR ART
FIG. 1A illustrates a prior art radio frequency lighting control system for remote control of electrical devices.
Figure 1B:
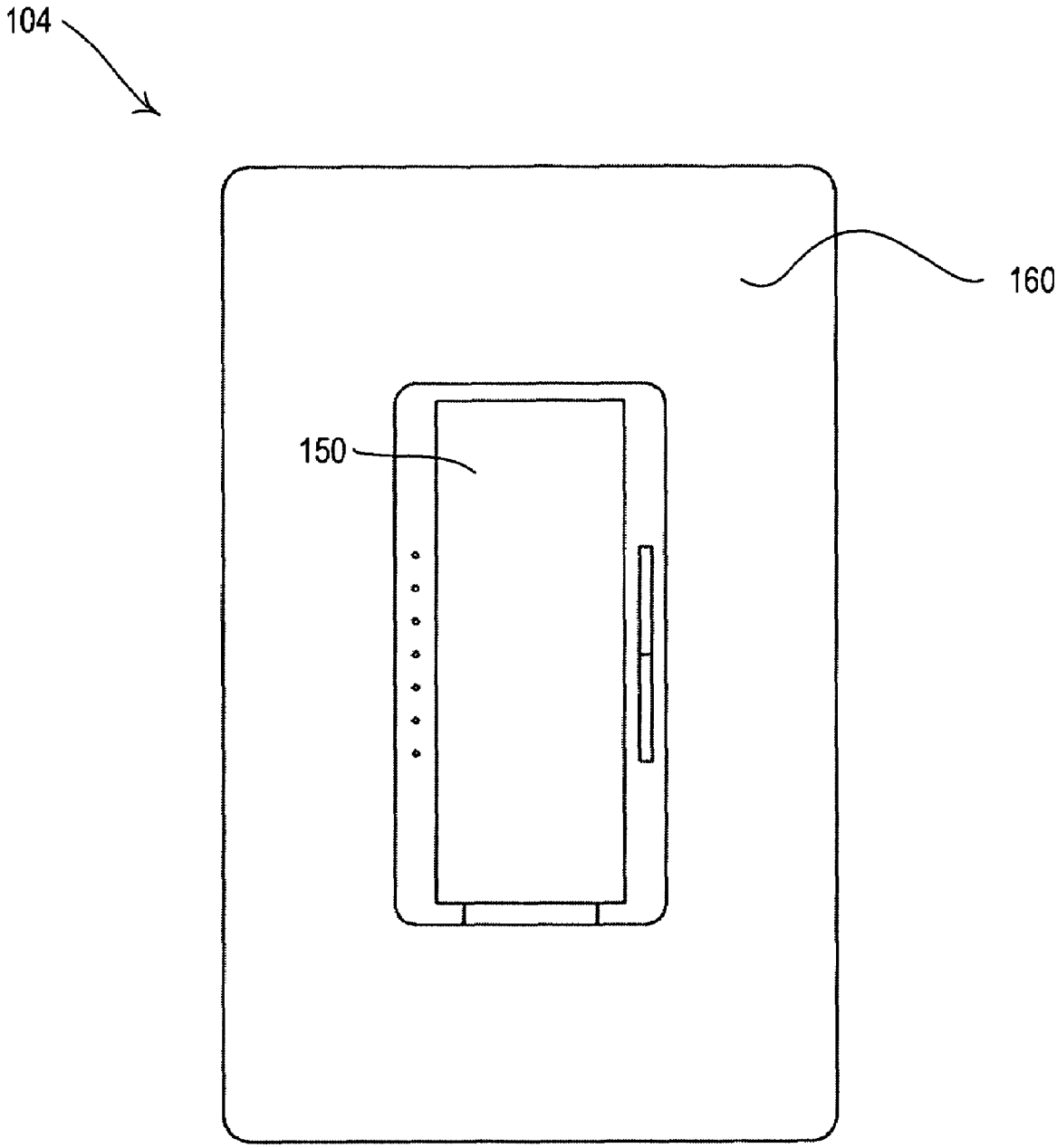
FIG. 1B PRIOR ART
FIG. 1B is a front view of a prior art lighting control device of the lighting control system of FIG. 1A.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2:
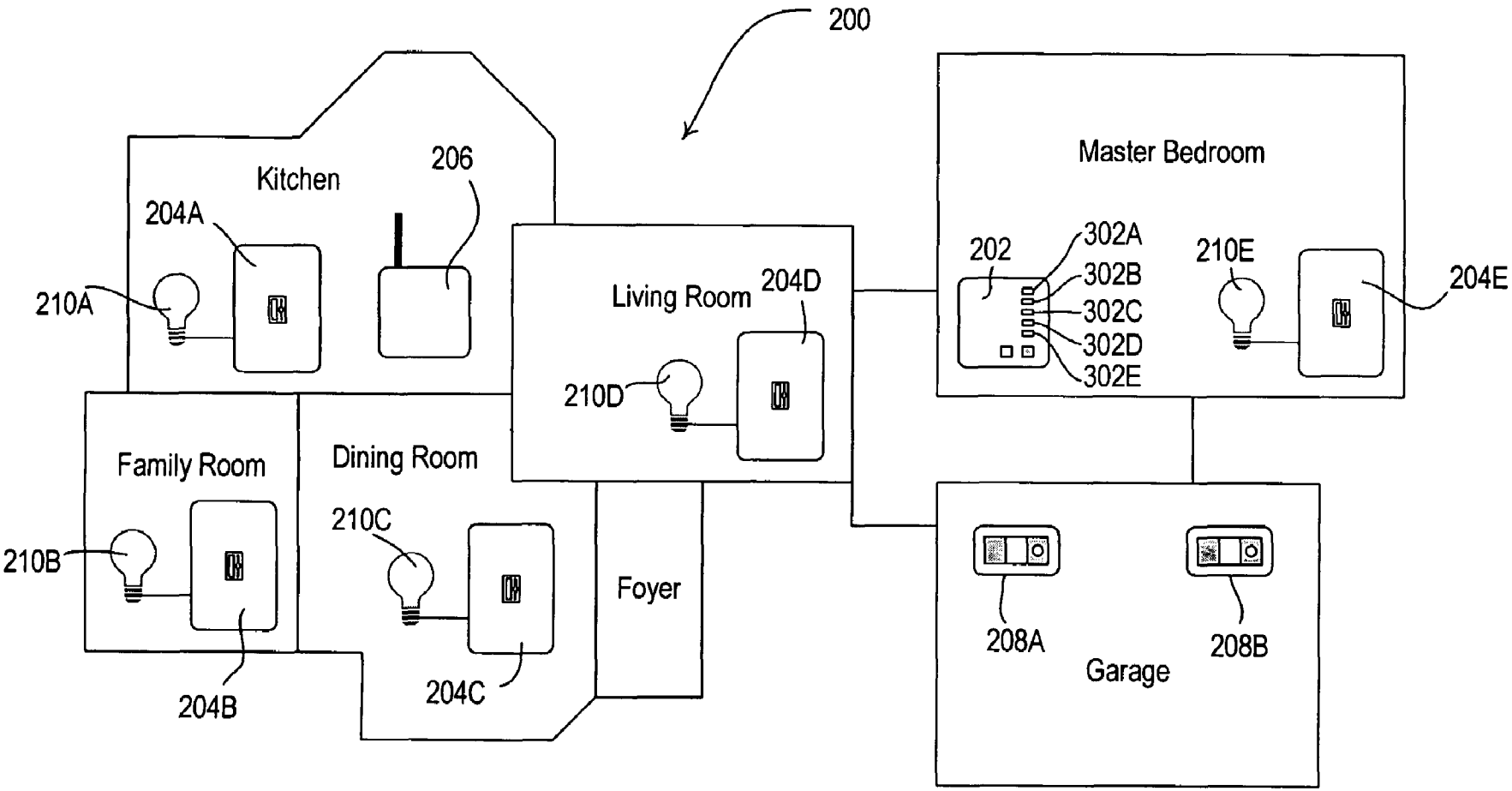
FIG. 2 shows an exemplary hardware arrangement of components and devices of an RF lighting control system according to a preferred embodiment of the present invention.

Referring to FIG. 2, an example hardware arrangement of components and devices in a building installation in accordance with a preferred embodiment of the present invention is displayed, and referred to herein generally as remote control system 200. As shown in FIG. 2, the system comprises, for example, one master control unit 202, five control devices 204A-204E, one repeater 206, and two car visor controls 208A, 208B, which represent a preferred combination of devices packaged and distributed for the retail market. In accordance with the teachings herein, each of the control devices 204A-204E is installed to replace a traditional mechanical switch. The control devices 204A-204E are coupled to electrical devices 210A-210E, respectively, for control of power delivered to the electrical devices. In the system 200 shown in FIG. 2, the electrical devices 210A-210E are electric lamps.

In a preferred embodiment of the present invention, the control devices 204A-204E and the master control unit 202 are preferably pre-programmed to support the functionality described herein without requiring configuration and programming by the user. Preferably, the master control unit 202 includes a plurality of device control buttons 302A-302E. Each of the device control buttons 302A-302E is operable to control one, and only one, of the control devices 204A-204E. For example, a first device button 302A on master control unit 202 is operable to cause unit 202 to transmit commands to which only the first control device 204A responds. The second device button 302B commands the second control device 204B; the third device button 302C commands the third control device 204C; and so forth.

Figure 3:
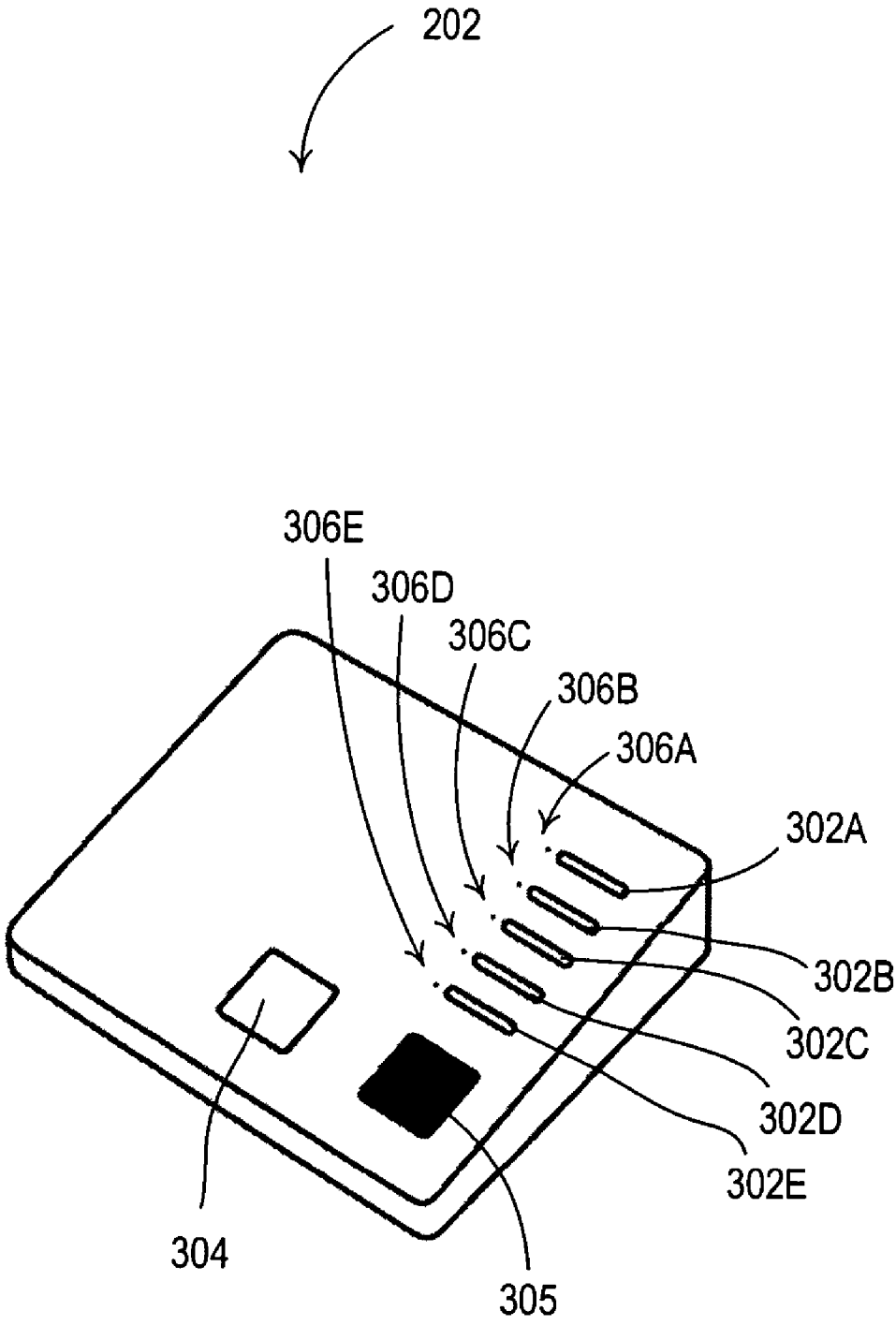
FIG. 3 shows a master control unit of the lighting control system of FIG. 2.

FIG. 3 illustrates an example master control unit 202 in accordance with the present invention. The example master control unit 202 shown in FIG. 3 is of the table top variety, plugs into a standard electric outlet, and can be placed anywhere in a home, such as, for example, on a bedside table. As noted above, the master control unit 202 can be provided in other various forms, including as a wall mounted device. The master control unit 202 includes the device buttons 302A-302E, which, when pressed, operate to cause the master control unit 202 to transmit a radio frequency signal and instruct the control device 204A to turn the electrical device 210A on or off. The master control unit 202 comprises an "all-on" button 304 (described in greater detail below), which operates to turn on a combination of the control devices 204A-204E to various levels, thereby providing a lighting preset (or "scene"). The master control unit 202 further comprises an "all-off" button 305, which operates to turn off all of the control devices 204A-204E when pressed. The master control unit 202 further comprises a plurality of status indicators 306A-306E for providing visual feedback about the status of the control devices 204A-204E to a user of system 200.

Figure 4:
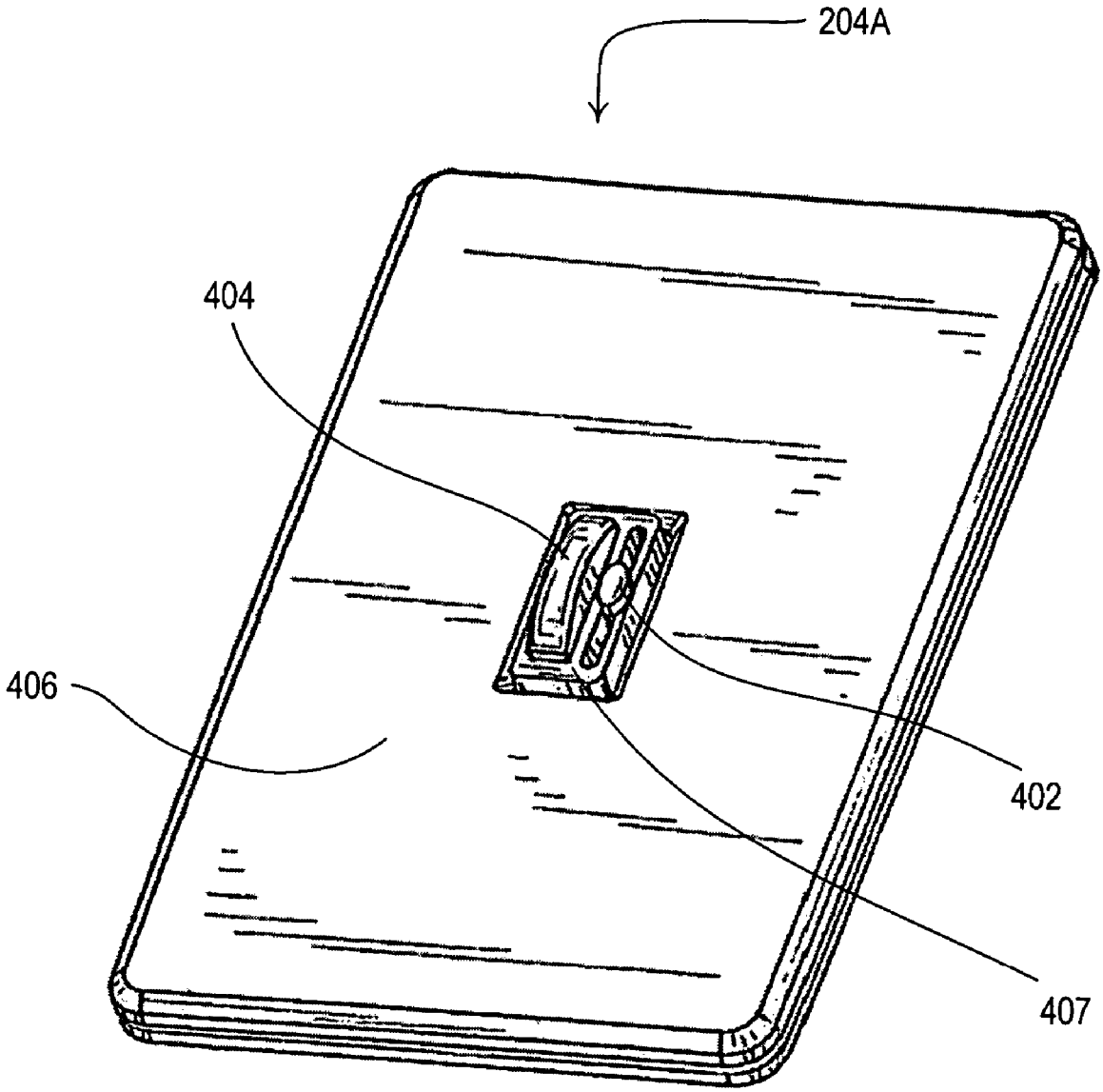
FIG. 4 is a perspective view of a load control device of the lighting control system of FIG. 2.

FIG. 4 is a perspective view of the load control device 204A according to the present invention. The load control device 204A is equipped with a slider control 402 and an actuator, e.g., a button 404. Actuation of the button 404 causes the load control device 204A to toggle an associated lighting load. Adjusting the slider control 402 changes the intensity of the lighting load. An antenna 410 (shown in FIGS. 5 and 7B) is preferably provided inside or behind the button 404 and is used for transmitting/receiving radio frequency signals to/from the master control unit 202, either directly or indirectly via the repeater 206. The control device 204A is preferably arranged with a faceplate 406. The faceplate preferably has a traditional-style opening, such that the faceplate can be used for the control devices 204A-204E as well as a standard mechanical wall switch. According to NEMA Standards Publication ANSI/NEMA, page 7, WD 6-2002, published by the National Electrical Manufacturers Association, Rosslyn, Va., the entire disclosure of which is hereby incorporated by reference, a traditional style opening is a rectangular opening having a minimum width of 0.401±0.005 inch, and a minimum length of 0.925±0.005 inch. A bezel 407 extends through the opening of the faceplate 406. The front surface of the bezel is substantially flush with the front surface of the faceplate 406.

Figure 5:
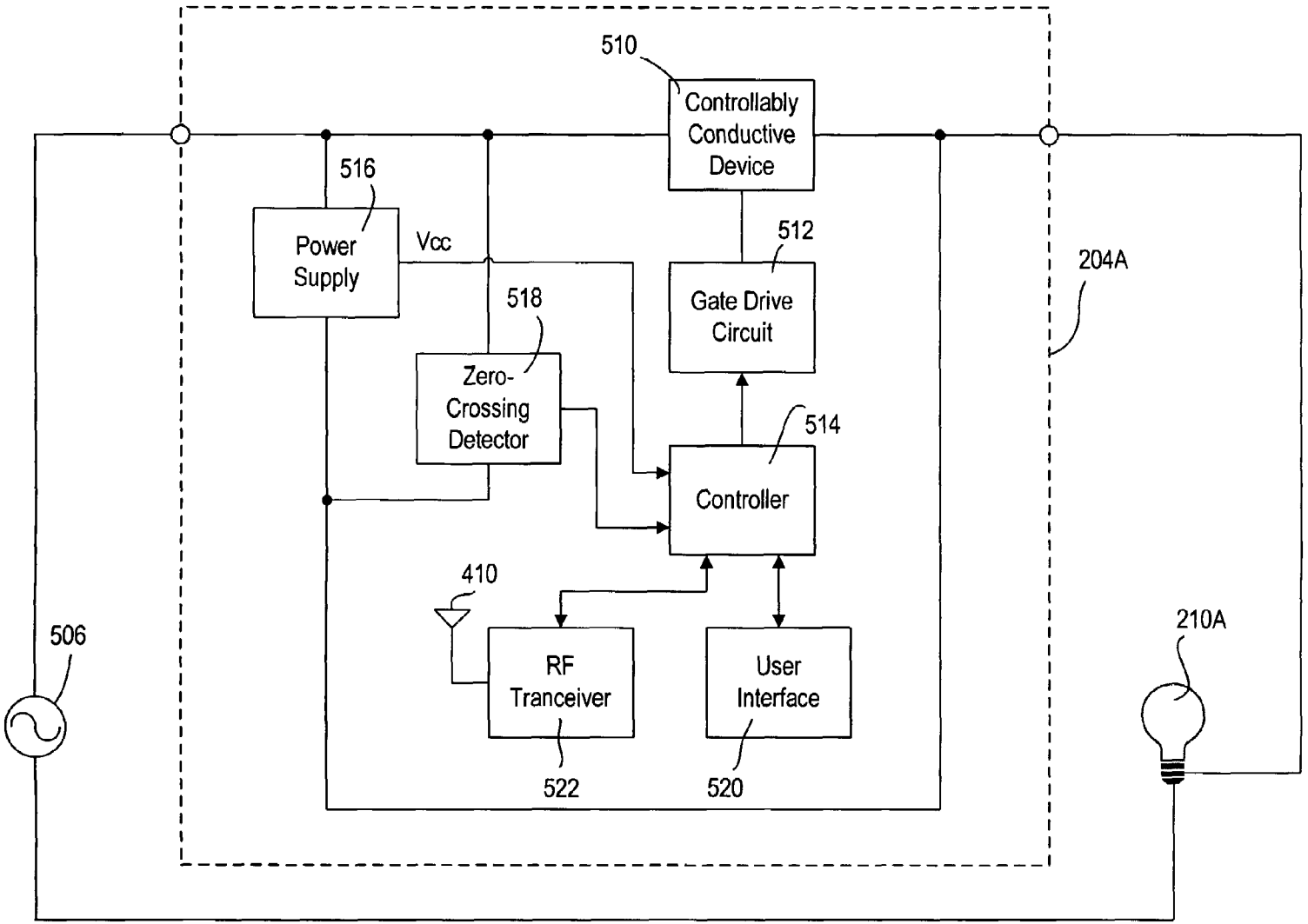
FIG. 5 is a simplified block diagram of the load control device of FIG. 4.

FIG. 5 is a simplified block diagram of the load control device 204A. The load control device 204A is coupled between an AC voltage source 506 and the lighting load 210A. The load control device 204A includes a controllably conductive device 510, such as a bidirectional semiconductor switch, for example, a triac. The controllably conductive device 510 may also be implemented as a relay or another type of semiconductor switch, such as two field effect transistors (FETs) in anti-series connection, a FET in a rectifier bridge, or one or more insulated gate bipolar junction transistors (IGBT). The controllably conductive device 510 has a control input (or gate), which is connected to a gate drive circuit 512. The input to the gate renders the controllably conductive device 510 selectively conductive or non-conductive, which in turn controls the power supplied to the lighting load 210A.

The gate drive circuit 512 provides control inputs to the controllably conductive device 510 in response to command signals from a controller 514. The controller 514 is preferably implemented as a microcontroller, but may be any suitable processing device, such as a programmable logic device (PLD), a microprocessor, or an application specific integrated circuit (ASIC). A power supply 516 is coupled across the controllably conductive device 510 and generates a DC voltage VCC to power the controller 514. The power supply 516 is only able to charge when the controllably conductive device 510 is non-conductive and there is a voltage potential developed across the load control device 204A.

A zero-crossing detector 518 determines the zero-crossing points of the AC voltage source 506 and provides this information to the controller 514. A zero-crossing is defined as the time at which the AC supply voltage transitions from positive to negative polarity, or from negative to positive polarity, at the beginning of each line voltage half-cycle. The controller 514 determines when to turn on (or turn off) the controllably conductive device 510 each half-cycle by timing from each zero-crossing of the AC supply voltage.

A user interface 520 is coupled to the controller 514 and provides a means for receiving inputs from a user and for providing feedback to the user. The user interface 520 preferably includes the button 404 and the slider control 402 as shown in FIG. 4. The controller 514 will toggle the state of the lighting load 210A (i.e., from on to off and vice versa) in response to an actuation of the button 404. The slider control 402 is operable to provide dimming of the lighting load 210A. In response to inputs from the slider control 402, the controller 514 controls the conductive state of the controllably conductive device 510 thereby to affect the dimming level of the lighting load 210A.

The load control device 204A further includes an RF transceiver 522 for transmitting and receiving RF communication signals from the other devices of the system 200 via an antenna 410. Once the controller 514 receives inputs from the user interface 520, the controller 514 then controls the lighting load 210A to the desired level set by the slider control 402, or to off, and then transmits a radio frequency signal to the master control unit 202 to identify the status of the lighting load 210A, which may be the intensity of the lighting load, or whether the lighting load is on or off, as determined by the controller 514.

Figure 6:
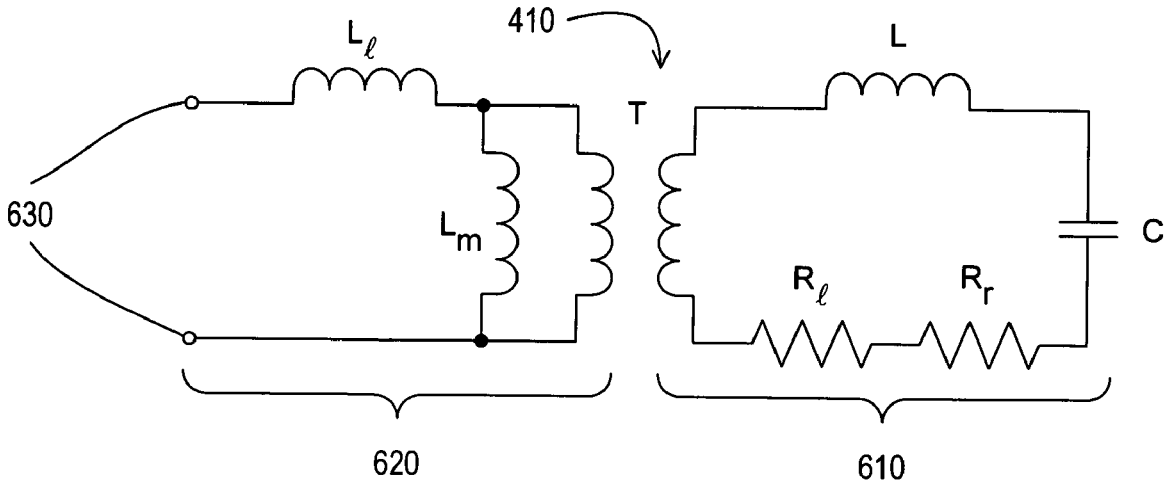
FIG. 6 shows an equivalent circuit of an antenna of the load control device of FIG. 4.

FIG. 6 shows an equivalent circuit of the antenna 410 according to the present invention. The antenna 410 is comprised of two parts: a main loop 610 and a feed loop 620. The main loop 610 is the primary radiating element of the antenna 410 and includes an inductance L and a capacitance C in series. When energized, the main loop 610 resonates at a frequency determined by the values of L and C and enables the transmitting and receiving of RF signals via a radiation resistance, $R_r$, which is a representation of the energy delivered to radiation. A loss resistance, $R_l$, represents the losses in the main loop 610. The main loop 610 is primarily magnetically coupled to the feed loop 620. This coupling is shown schematically in FIG. 6 by an ideal transformer T. The feed loop 620 includes a magnetizing inductance $L_m$, a leakage inductance $L_l$, and two ends 630 that connect to the RF transceiver 522. The feed loop 620 allows for the conduction of signals between the RF transceiver 522 and the main loop 610.

In this way, the antenna 410 is adapted to receive RF signals via the main loop 610, with those radio frequency signals being electromagnetically coupled to the feed loop 620 for input to the RF transceiver 522. Conversely, the feed loop 620 receives signals to be transmitted from the RF transceiver 522, electromagnetically couples these signals to the main loop 610 for transmission of RF signals to a master or repeater device.

Figure 7A:
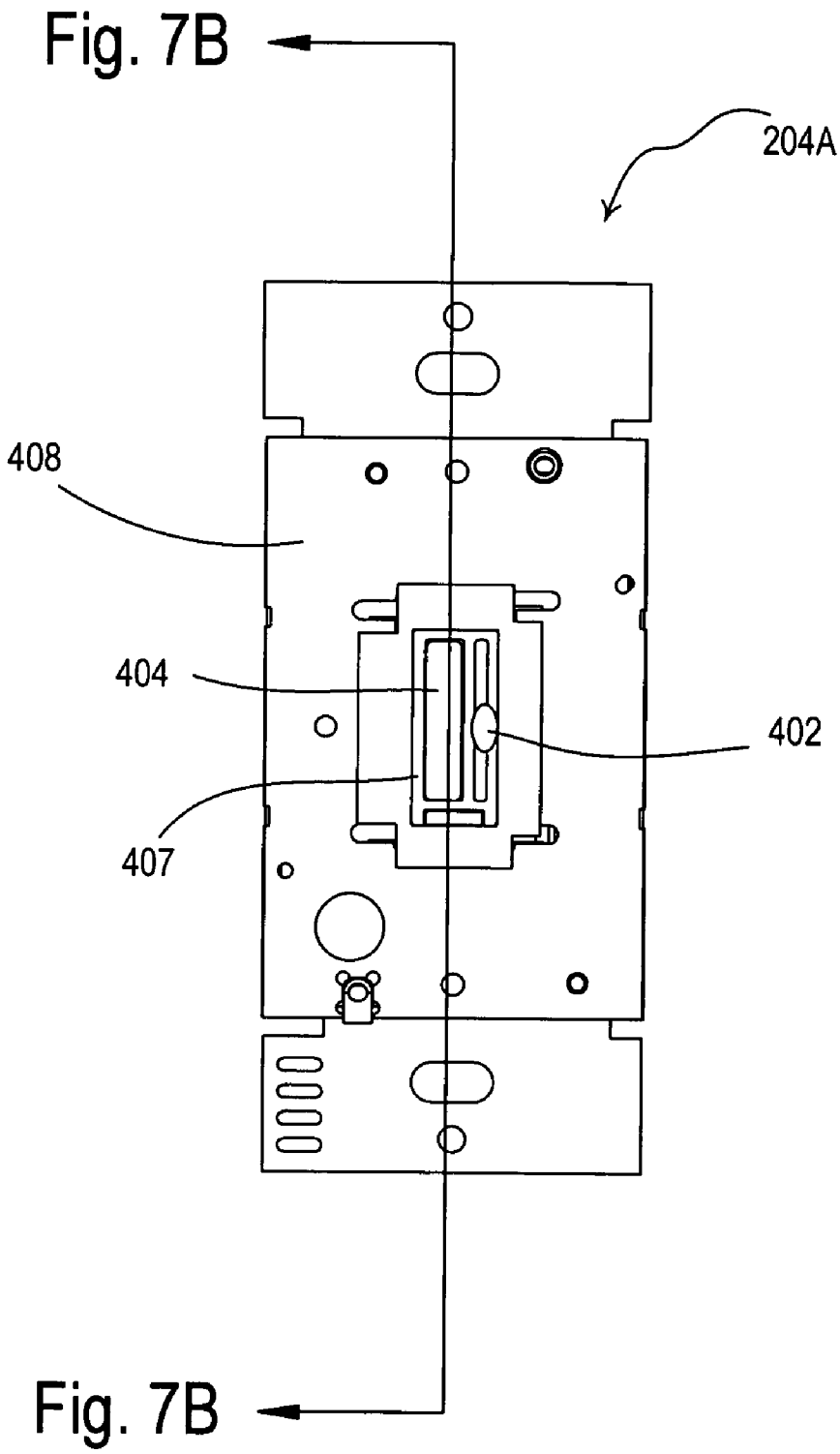
FIG. 7A shows a front view of the load control device of FIG. 4 without a faceplate.
Figure 7B:
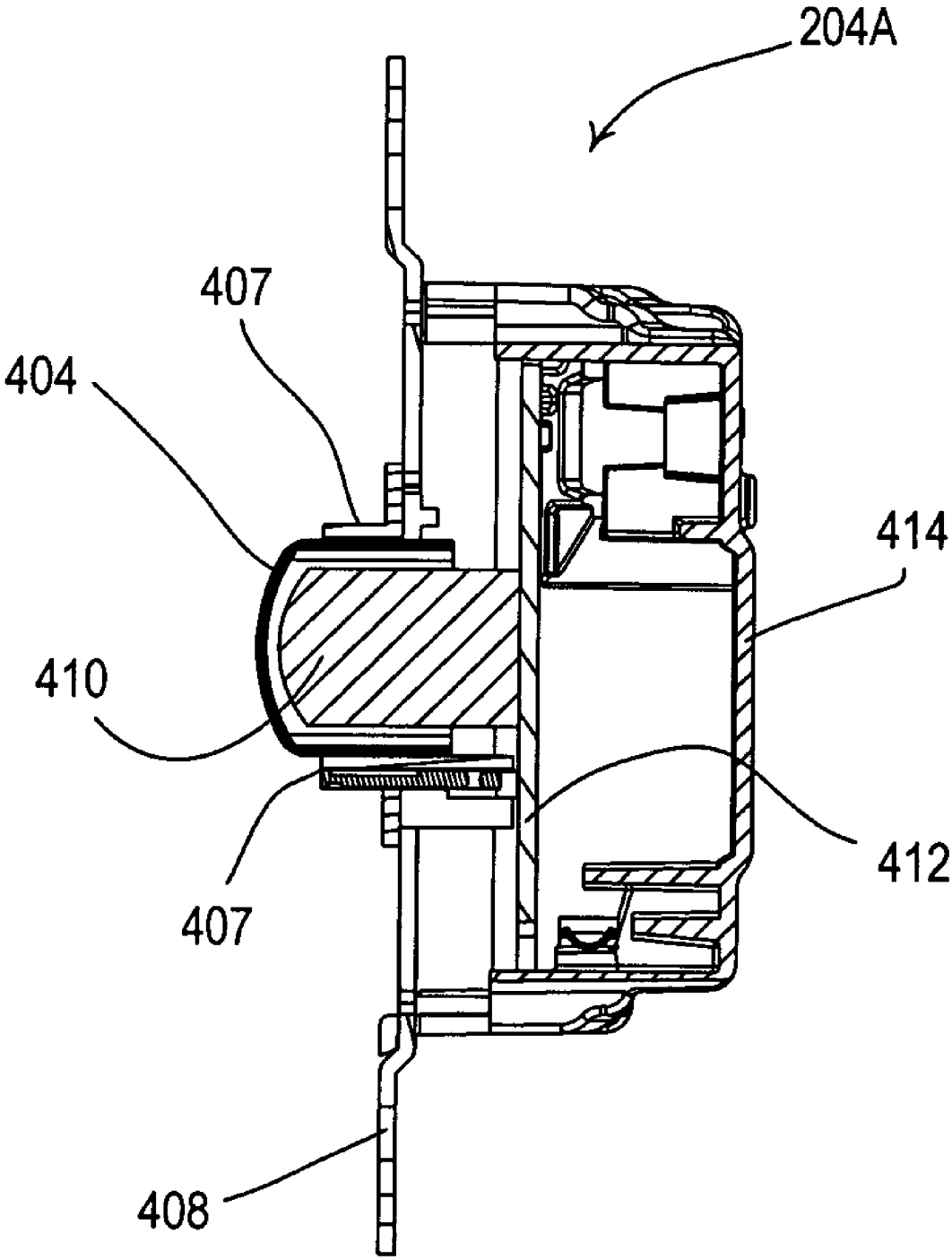
FIG. 7B shows a right side cross-sectional view of the load control device of FIG. 4 without a faceplate.

FIG. 7A shows a front view of the load control device 204A, without the faceplate 406 installed, including a yoke 408. FIG. 7B shows a right side cross-sectional view of the load control device 204A of FIG. 7A. An antenna 410 is provided on a printed circuit board inside and behind the button 404 in the plane of the drawing paper. The antenna 410 extends beyond the front surface of the bezel 407 (which is substantially flush with the front surface of the faceplate 406 as shown in FIG. 4). Accordingly, the antenna 410 protrudes through the opening of the faceplate 406 and extends beyond the faceplate. The positioning of the antenna 410 increases the transmission range of the antenna, particularly when the faceplate comprises a metal faceplate. The antenna 410 connects to a dimmer printed circuit board (PCB) 412 that includes the controllably conductive device 510, the gate drive circuit 512, the controller 514, the power supply 516, the zero-crossing detector 518, the user interface 520, and the RF transceiver 522. The yoke 408 and a back cover 414 enclose the PCB 412.

Figure 8A:
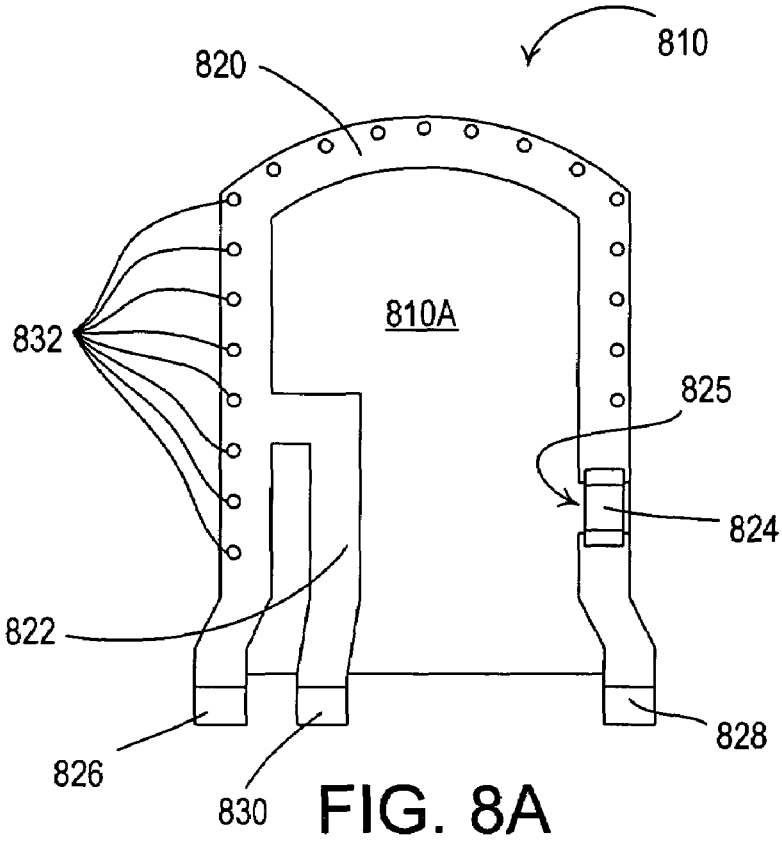
FIGS. 8A and 8B show the first and second sides, respectively, of a first embodiment of an antenna of the load control device of FIG. 4.
Figure 8B:
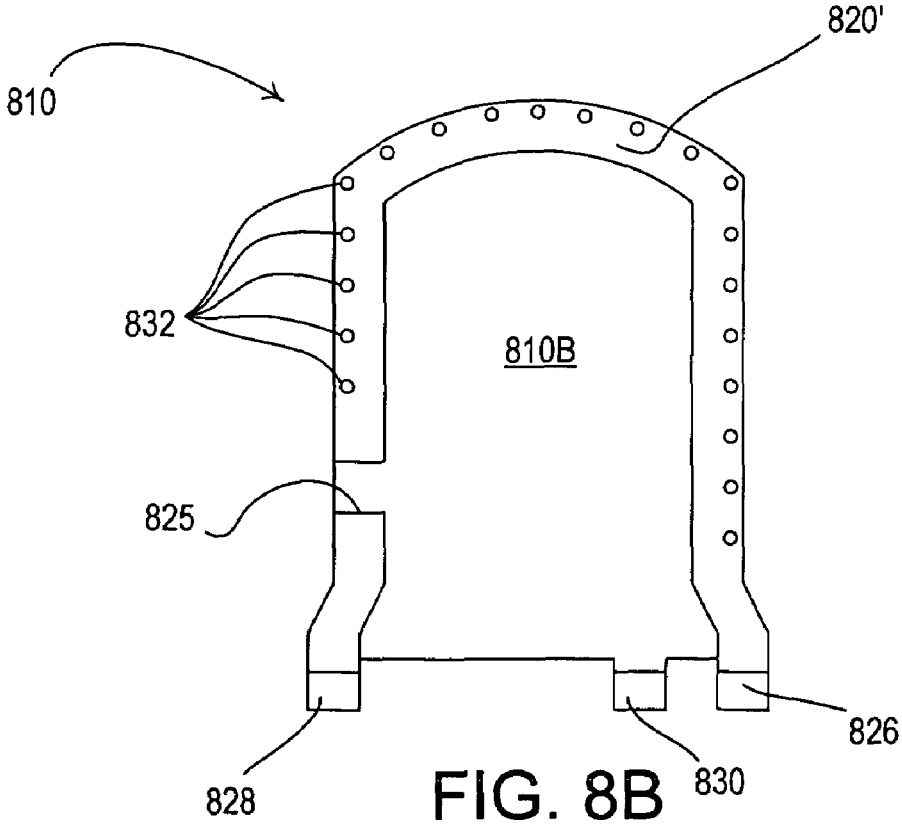

A first side 810A and a second side 810B of an antenna 810 for the load control device 204A according to a first embodiment of the present invention is shown in FIGS. 8A and 8B, respectively. The antenna 810 includes a main loop trace 820 and a feed loop trace 822 that intersects with the main loop trace. Thus, the main loop of the antenna 810 is not electrically isolated from the feed loop. A capacitor 824 is provided across a break 825 in the main loop trace 820. The antenna 810 is formed on a printed circuit board and includes three terminals 826, 828, 830 for connection to the dimmer PCB 412. The main loop terminates at the two outer terminals 826, 828, while the feed loop is connected to the inner terminal 830. A main loop trace 820' is provided on the second side 810B of the antenna 810 and is connected to the main loop trace 820 on the first side 810A through a plurality of vias 832.

The main loop terminals 826, 828 are connected to circuit common on the dimmer PCB 412. The feed loop terminal 830 is connected to the RF transceiver 522 on the dimmer PCB 412. When a signal is conducted from the transceiver to the feed loop terminal 830, current flows through the feed loop trace 822, the main loop traces 820, 820', and the main loop terminals 826, 828 to circuit common on the dimmer PCB 412. The main loop is substantially only magnetically coupled to the feed loop, and thus, a current having a larger magnitude is induced in the main loop trace 820 when current flows through the feed loop trace 822. This current flows through the main loop terminals 826, the main loop traces 820, 820', the capacitor 824, and the main loop terminal 828. The main radiating loop 820, 820' is positioned in relation to the feed loop 822 such that substantially all of the magnetic flux generated by the current flowing through the feed loop 822 passes through both the area circumscribed by the feed loop 822, and the area circumscribed by the main loop 820, 820'.

Figure 9A:
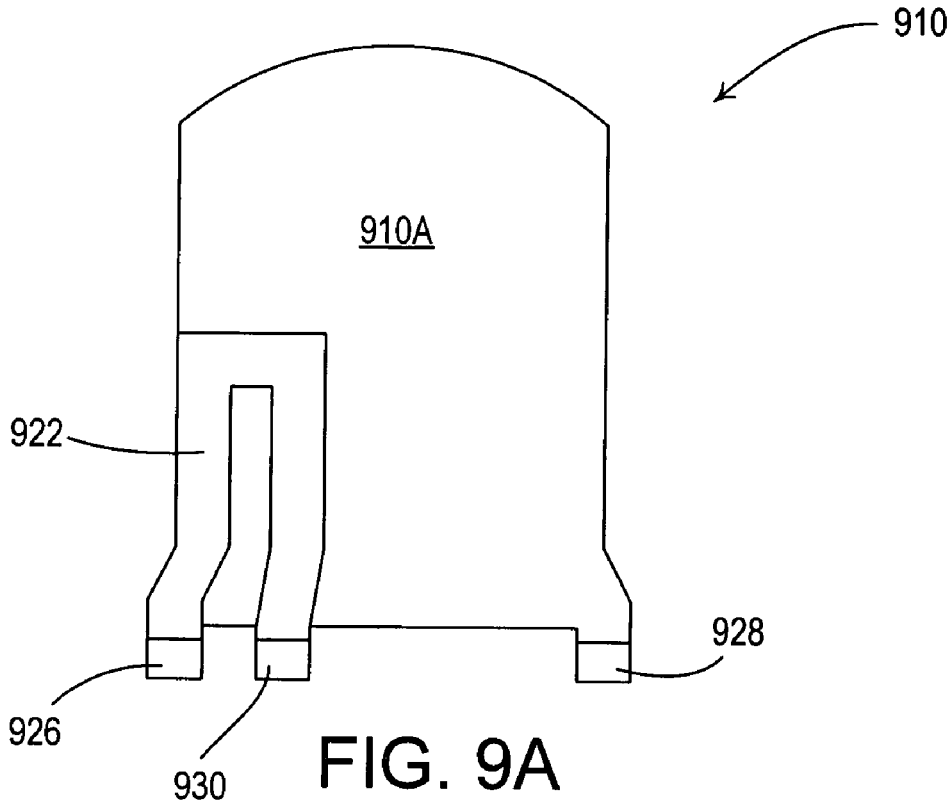
FIGS. 9A and 9B show the first and second sides, respectively, of a second embodiment of an antenna of the load control device of FIG. 4.
Figure 9B:
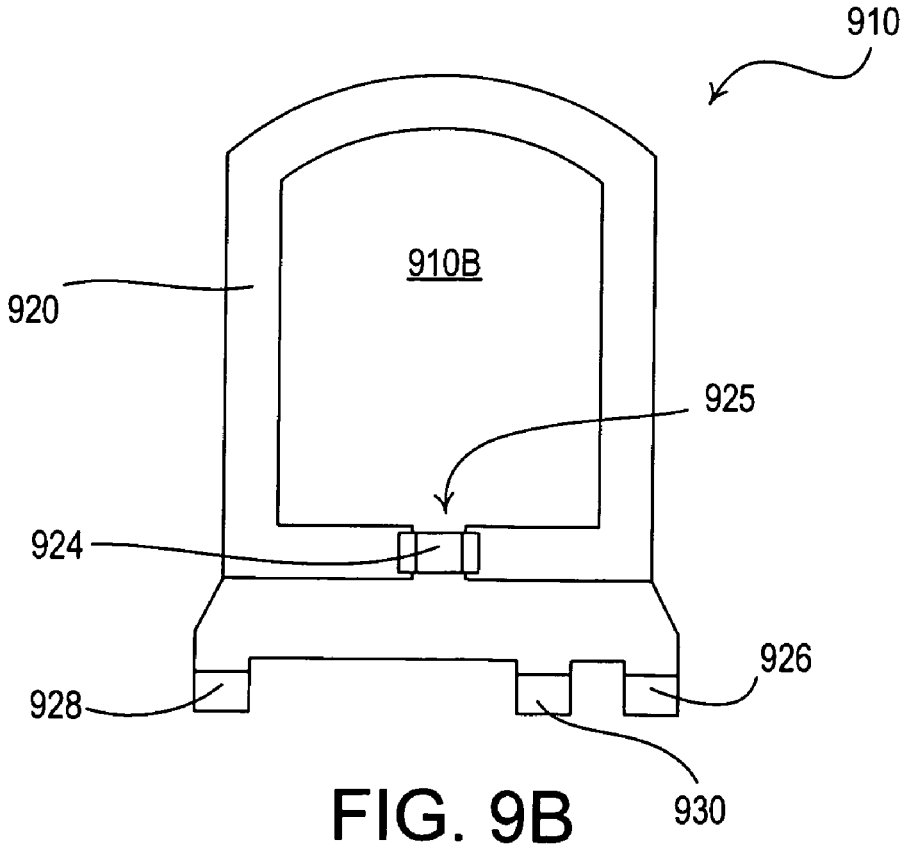

An antenna 910 for the load control device 204A according to a second embodiment of the present invention is shown in FIGS. 9A and 9B. As shown in FIG. 9A, a first side 910A of the antenna 910 includes a feed loop trace 922 that terminates at two terminals 926, 930. A main loop trace 920 is provided on a second side 910B of the antenna 910 as shown in FIG. 9B and is electrically isolated from the feed loop trace 922. The main loop trace 920 includes a break 925 with a capacitor 924 disposed across the break. A third tab 928 is provided on the PCB of the antenna 910 to aid in connection of the antenna to the dimmer PCB 412.

The terminal 926 is connected to circuit common on the dimmer PCB 412, while the terminal 930 is coupled to an RF transceiver. When a signal is conducted from the transceiver to the feed loop terminal 930, current flows through the feed loop trace 922 and the terminal 926. Accordingly, a current is induced in the main loop trace 920 due to the magnetic coupling of the main loop and the feed loop and an RF signal is transmitted from the load control device 204A.

Although the words "device" and "unit" have been used to describe the elements of the lighting control systems of the present invention, it should be noted that each "device" and "unit" described herein need not be fully contained in a single enclosure or structure. For example, the master control unit 202 of FIG. 2 may comprise a plurality of buttons in a wall-mounted device and a processor that is included in a separate location.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An antenna for an electrical load control device for controlling the power delivered to an electrical load, the load control device comprising a controllably conductive device for controlling the power delivered to the electrical load, a controller coupled to a control input of the controllably conductive device for control of the controllably conductive device, a transmitter and/or receiver in communication with the controller, a substantially-planar mounting yoke adapted to receive a traditional-style faceplate mounted thereto, an actuator button for providing an input to the controller, and a backcover connected to the yoke to enclose the controllably conductive device, the controller, and the transmitter and/or receiver, the actuator button mounted relative to the yoke, such that the actuator button is adapted to extend through an opening of the traditional-style faceplate when the faceplate is attached to the yoke, the antenna coupled to the transmitter and/or receiver and operable to transmit or receive radio frequency signals at a specified frequency, the antenna comprising:

an antenna printed circuit board having first and second sides adapted to be disposed in a plane perpendicular to the mounting yoke;

a first loop of conductive material having an inductance and a capacitance, the capacitance and the inductance forming a circuit resonant at the specified frequency, the first loop formed on the first side of the printed circuit board; and a second loop of conductive material having two ends adapted to be electrically coupled to the transmitter and/or receiver, the second loop formed on one of the sides of the printed circuit board and magnetically coupled to the first loop;

wherein the antenna is positioned inside and behind the actuator button and extends through the opening of the faceplate beyond a front surface of the faceplate when the faceplate is attached to the yoke.

2. The antenna of claim 1, wherein the second loop is only magnetically coupled to the first loop and electrically insulated from the first loop.

3. The antenna of claim 2, wherein the second loop of conductive material is formed on the second side of the printed circuit board.

4. The antenna of claim 1, wherein the electrical load comprises a lighting load and the load control device comprises a dimmer switch.

5. The antenna of claim 4, wherein the load control device comprises a dimmer printed circuit board enclosed by the yoke and the backcover, the controllably conductive device, the controller, and the transmitter and/or receiver mounted to the dimmer printed circuit board, and wherein the antenna printed circuit board is connected to the dimmer printed circuit board, such that the antenna printed circuit board is disposed in a plane perpendicular to the dimmer printed circuit board.

6. The antenna of claim 5, wherein the antenna printed circuit board comprises terminals connected to the dimmer printed circuit board.

7. The antenna of claim 6, wherein the first loop of conductive material is connected to a circuit common of the dimmer printed circuit board via at least one of the terminals, and the second loop of conductive material is connected to the transmitter and/or receiver via another one of the terminals.

8. The antenna of claim 1, wherein the first loop of conductive material intersects with the second loop of conductive material.

9. The antenna of claim 8, wherein the second loop of conductive material is formed on the first side of the antenna printed circuit board.

10. The antenna of claim 9, wherein the antenna comprises a trace of conductive material provided on the second side of the antenna printed circuit board, the trace electrically connected to the first loop of conductive material on the first side of the antenna printed circuit board through a plurality of vias.

11. The antenna of claim 1, wherein the first loop of conductive material comprises a break and the capacitance of the first loop comprises a capacitor provided across the break.

12. The antenna of claim 1, wherein a first current flows in the first loop of conductive material when a second current flows through the second loop of conductive material, the first current having a magnitude larger than the magnitude of the second current.

13. The antenna of claim 1, wherein the faceplate comprises a metal faceplate.

* * * * *